United States Patent [19]

Reist

[11] Patent Number: 4,523,775

[45] Date of Patent: Jun. 18, 1985

[54] FOLDED PRINTED SHEET OR PRINTED SHEET INTENDED TO BE FOLDED AND METHOD AND APPARATUS FOR FABRICATION THEREOF

[75] Inventor: Walter Reist, Hinwil, Switzerland

[73] Assignee: Ferag AG, Hinwil, Switzerland

[21] Appl. No.: 390,505

[22] Filed: Jun. 21, 1982

[30] Foreign Application Priority Data

Jun. 29, 1981 [CH] Switzerland ..... 4267/81

[51] Int. Cl.[3] ..... B42F 21/00

[52] U.S. Cl. ..... 283/36; 40/359

[58] Field of Search ..... 283/36–42; 40/359

[56] References Cited

U.S. PATENT DOCUMENTS

| | | | |
|---|---|---|---|
| 949,514 | 2/1910 | Achter | 283/39 |
| 1,054,239 | 2/1913 | Probasco | 40/359 X |
| 1,697,985 | 1/1929 | Lindsay | 40/359 |
| 1,730,644 | 10/1929 | Clark | 40/359 |
| 2,037,579 | 4/1936 | Jonas | 40/359 |
| 2,264,119 | 11/1941 | Lichter | 283/36 |
| 2,850,016 | 9/1958 | Matheny | 40/359 |
| 3,999,701 | 12/1976 | Ward | 40/359 X |

FOREIGN PATENT DOCUMENTS

| | | | |
|---|---|---|---|
| 393257 | 10/1965 | Switzerland . | |
| 961704 | 6/1964 | United Kingdom | 40/359 |

*Primary Examiner*—Frank T. Yost

*Attorney, Agent, or Firm*—Werner W. Kleeman

[57] ABSTRACT

At an edge of one side of the printed sheet and which extends in the direction of a fold line there is provided a substantially triangular-shaped protruding portion. At the edge of the other side of the printed sheet, which is located opposite the fold line, there is provided an inset or retracted portion which in its size essentially corresponds to the protruding portion. At this protruding portion there can engage an opening device for opening the folded printed sheet. At the end of the processing or handling operation the protruding portion is cut away as waste. The thus cut away material portion of the protruding portion corresponds in its surface area to the material portion which is missing at the other side of the sheet at the location of the inset or retracted portion. The loss of material caused by the elimination of the protruding portion therefore is accomplished at the expense of the other side of the printed sheet.

8 Claims, 15 Drawing Figures

FOLDED PRINTED SHEET OR PRINTED SHEET INTENDED TO BE FOLDED AND METHOD AND APPARATUS FOR FABRICATION THEREOF

BACKGROUND OF THE INVENTION

The present invention relates to a folded printed sheet or a printed sheet intended to be folded, and also pertains to a novel method and apparatus for the fabrication thereof.

The printed sheet of the invention which is folded or intended to be folded is of the type containing at least one protruding portion located at a first side edge extending in the direction of the fold line of the printed sheet.

While the invention is generally specifically applicable in conjunction with printed sheets as such, it is to be understood that the term "printed sheet", as used in the context of this disclosure, is employed in its broader sense to also encompass sheets which have not been specifically printed.

It is known to the art, in the case of folded printed sheets, especially so-called tabloid formats, to provide a protruding portion, a so-called pre-fold, at a side edge extending essentially parallel to the fold. This protruding portion or pre-fold extends at a constant width over the entire length of the related side edge. As is known this protruding portion serves for the opening of the folded printed sheet as well as for the withdrawal of the printed sheet from a stack. After there has been accomplished the stacking or tucking into one another, as the case may be, of the printed sheets, their protruding portions are cut away as waste. Even if this cut away portion is not very wide, typically for instance amounting to about 8 millimeters, nonetheless in consideration of the large number of processed printed sheets there is still present an appreciable loss in paper which reflects itself in the costs.

SUMMARY OF THE INVENTION

Therefore, with the foregoing in mind it is a primary object of the present invention to provide a new and improved construction of printed sheet which is folded or intended to be folded, which is not afflicted with the aforementioned drawbacks or shortcomings of the prior art sheet constructions.

Still a further significant object of the present invention is directed to a printed sheet of the previously mentioned type, which can be faultlessly manipulated just as was heretofore the case with the prior art sheets, in particular, can be readily and efficiently opened, but wherein however the severing of the protruding portion is not accompanied by increased costs due to loss of paper material.

Yet a further important object of the present invention aims at a new and improved construction of paper sheet which can be folded or is folded, which paper sheet is designed such that it can be readily manipulated, particularly opened, and wherein the severing of the protruding portion of the paper sheet encompasses the removal of less material than with the prior art paper sheet constructions.

A further significant object of the present invention is directed to a new and improved method of fabricating such paper sheets and an apparatus for the performance of such method.

Now in order to implement these and still further objects of the invention, which will become more readily apparent as the description proceeds, the printed sheet of the present development is manifested by the features that, the protruding portion only extends over a portion of the length of the first side edge, and at the second side edge of the sheet, which is located opposite the first side edge with respect to the fold line, there is provided an inset or retracted portion which essentially corresponds in its shape to the shape of the protruding portion.

In the context of this disclosure and to the extent appropriate, the term "inset portion" or "retracted portion" or "receding portion" is that part of the sheet which is cut away at the second edge and which cut away portion has a shape or area essentially like that of the protruding portion at the first side edge.

Since the protruding portion only extends over a part of the related side length of the sheet, the material portion or part which is removed during the cutting operation is smaller than with the heretofore known printed sheets. Additionally, since this removed material portion has been obtained by the formation of the same size inset or retracted portion at the other side edge of the sheet, the loss in material during the cutting operation is advantageously accomplished at the expense of the missing portion at this other side edge of the sheet, so that, in effect, for the printed sheet operator or plant there are not present any increased costs. The protruding portion or part which is severed at the one side edge is thus effectively saved at the other side edge. A characteristic feature of the printed sheet of the present development therefore is constituted by the absence of at least one portion or part at least at one of its side edges extending essentially parallel to the fold line.

The notches formed by the inset or retracted portions can form a gripper or indexing register or tab facility in the final product which is composed of a number of printed products which are tucked or stuffed into one another, thereby facilitating for the reader quick opening of the final printed product to a predetermined location, for instance to the center thereof.

Although the protruding portion no longer occupies the entire length of the side edge, there is nonetheless possible a faultless opening of the folded printed sheet.

Preferably, there are present both at the first side edge and also at the second side edge at least one protruding portion and at least one inset or receding portion, which corresponds to the protruding portion located at the other or opposite side edge. With such design it is possible to seize both sides in order to open these folded printed sheets.

Printed sheets constructed according to the invention can be preferably fabricated in that, a transported or moved material web is cut transversely with respect to its direction of movement along a cutting line which is bent or flexed at least one time, or else along a straight cutting line which however extends at an inclination with regard to the direction of movement of the material web.

For this purpose there can be employed an apparatus constructed according to the invention which contains a cutting device for cutting the transported or moved material web along a cutting line extending transversely with respect to the direction of movement of the material web, and which cutting line is bent or flexed at least once, or else along a straight cutting line which however extends at an inclination with regard to the direction of movement of the material web.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 1C:
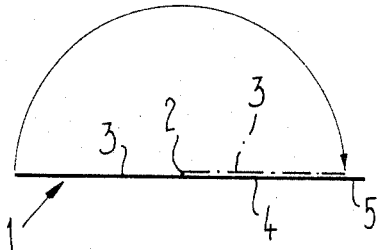
FIG. 1*c* illustrates an end view of the unfolded printed sheet of the arrangement of FIG. 1*a;*
Figure 1A:
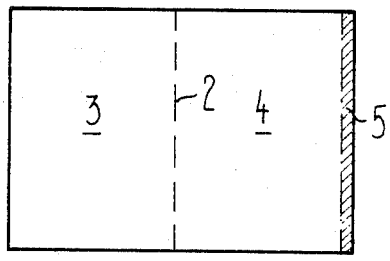
FIG. 1*a* illustrates a prior art construction of printed sheet in top plan view in its open or unfolded condition.
Figure 1B:
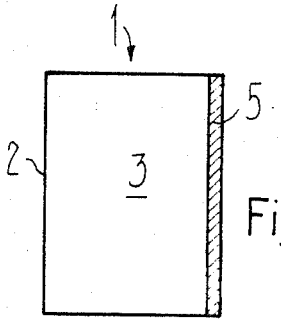
FIG. 1*b* illustrates the prior art sheet of FIG. 1*a* in its folded condition where it has been folded over along its fold line.

Turning attention now to the drawings, in FIGS. 1*a,* 1*b* and 1*c* there has been illustrated a printed sheet 1 constructed according to the teachings of the prior art. In particular, FIGS. 1*a* and 1*c* respectively show the open printed sheet 1 in top plan view and in side view, whereas FIG. 1*b* illustrates, in top plan view, the folded printed sheet 1. This printed sheet 1 will be seen to comprise two sides or sheet portions 3 and 4 which are separated from one another by a fold line 2. Protruding from the side edge of the side or sheet portion 4, which extends essentially parallel to this fold line 2, is a substantially rectangular portion 5, the so-called pre-fold. This pre-fold 5 extends at essentially a constant width over the entire height of the related side or sheet portion 4. At this protruding portion 5 there can engage, in known manner, suitable opening devices for opening the folded printed sheet 1, such as known to the art, for instance, from German Patent Publication No. 3,047,436.

The opened printed sheets 1 can be stuffed or tucked within one another, for instance, by collecting or bringing them together so as to form an appropriate final or end product. After assembling together the printed sheets 1 the protruding portions 5 are cut away as waste. It will be readily evident that as a result of this cutting operation there is present an appreciable loss in waste paper for the business establishment or plant which processes such printed sheets.

Figure 2A:
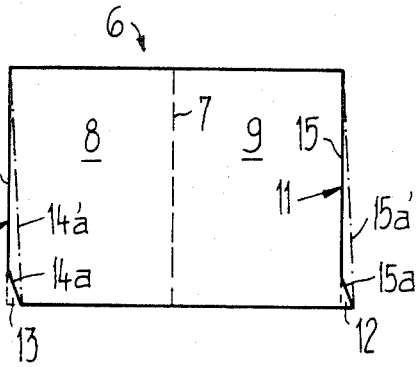
FIG. 2*a* is a top plan view of a first exemplary embodiment of printed sheet according to the invention in its open or unfolded condition.

It is a primary aim of the present invention to avoid this undesirable phenomenon when processing the printed sheets. In FIGS. 2*a,* 2*b* to 7*a,* 7*b* there have been illustrated in the open and closed condition, respectively, different possible constructions of inventive printed sheets 6.

All of these printed sheets 6 likewise possess two sides or sheet portions 8 and 9 which are separated from one another by a fold line 7. The opposite side edges of the sides or sheet portions 8 and 9, which extend in the direction of such fold line 7, have been generally designated by reference characters 10 and 11, respectively. At one of these side edges 10 and 11, such as the side edge 11 for instance, there is provided at least one protruding portion 12, whereas at the other side edge, thus the side edge 10, there is provided at least one inset or retracted portion 13. As to the different embodiments of printed sheets 6 the same differ by virtue of the arrangement and the number of such protruding portions 12 and inset or retracted portions 13.

Figure 2B:
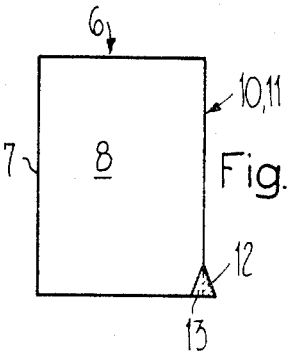
FIG. 2*b* illustrates the printed sheet of FIG. 2*a* after having been folded.

Thus, for instance, with the exemplary embodiment of printed sheet 6 depicted in FIGS. 2*a* and 2*b,* the portions or parts 12 and 13 are arranged at one end of the related side edges 10 and 11, respectively, and each such portion 12 and 13 possesses a triangular configuration. The side edges 10 and 11 are bounded or defined by a once bent line which contains a region 14 and 15, respectively, extending essentially parallel to the fold line 7, and a region 14*a* and 15*a,* respectively, which encloses an angle with the related adjoining region 14 and 15. The printed sheet 6 can be cut from a web of material by a suitable cutting knife or implement at the edges 10 and 11, so as to have such angled or flexed configuration which is composed of the two respective neighboring portions 14, 14*a* and 15, 15*a* at the side edges 10 and 11, respectively.

However, it is to be understood that the printed sheet 6 can be differently cut or configured. For instance, in FIG. 2*a* there has been illustrated by the broken or phantom lines 14*a'* and 15*a'* that the region of the side edge lines or side edges can extend differently, for instance, as here shown, at an inclination with respect to the fold line 7 and can possess any random desired course.

Now if the printed sheet 6, provided with the portions 12 and 13 as explained heretofore, is folded along the fold line 7, then it will be readily evident that the triangular-shaped protruding portion 12 protrudes past the superimposed side edges 10 and 11, as the same has been readily shown in FIG. 2*b.* By the same token, there is missing at the side or sheet portion 8 a part thereof corresponding to the inset or retracted portion 13 which, as stated, is of the same size or area as the protruding portion 12. At the protruding portion 12 and the part of the sheet portion 9 which is exposed or laid free by the inset portion 13 there can be introduced, in conventional manner, an opening device for the purpose of cleanly and easily opening the folded printed sheet 6.

At the completion of the processing operation of the printed sheets 6 the protruding portion or part 12 is then cut away as waste along a cutting line defined by the side edge 11. As far as the printing sheet operator is concerned there does not thereby arise any loss in paper material, since the cut away portion 12 has, in effect, been saved by the missing part defining the inset portion 13 which is located at the other side or sheet portion 8.

Figure 3A:
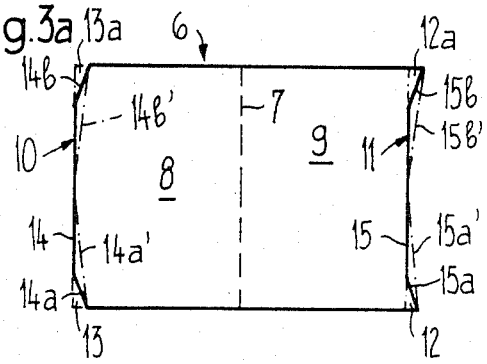
FIG. 3*a* is a view, comparable to the showing of FIG. 2*a,* of a second embodiment of printed sheet in its open or unfolded condition.
Figure 3B:
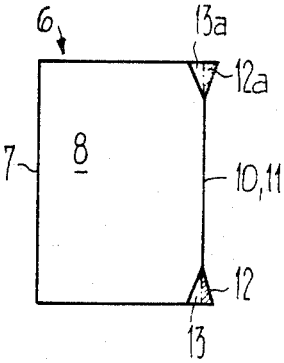
FIG. 3*b* is a view, comparable to the showing of FIG. 2*b,* showing the printed sheet of FIG. 3*a* in its folded condition.

Continuing, the modified embodiment of printed sheet 6, as shown in FIGS. 3*a* and 3*b*, differs from the previously described embodiment of FIGS. 2*a* and 2*b* in that, here, at both ends of the side edges 10 and 11, in other words at the lower and upper ends of the showing of such FIGS. 3*a* and 3*b*, there is provided a respective protruding portion 12 and 12*a* and a respective inset or retracted portion 13 and 13*a*. The boundary lines of the side edges 10 and 11 are therefore consituted by two regions 14*a* and 14*b* and 15*a* and 15*b*, respectively, which form an angle with the related immediate regions 14 and 15 extending essentially parallel to the fold lines 7. At the folded product or sheet 6 there are now present two protruding portions 12 and 12*a*, at which there can engage the opening device, as will be readily recognised by referring to FIG. 3*b*. Also with this exemplary embodiment the portions or parts 12 and 12*a* which are eliminated by the cutting operation along a cutting line defined by the side edge 11 are compensated, in terms of as to the material thereof, by the inset or retracted portion 13 and 13*a*, specifically by the material parts defining the inset portions 13 and 13*a* which are missing from the sheet by virtue of the novel method of cutting the same as heretofore explained.

Figure 4A:
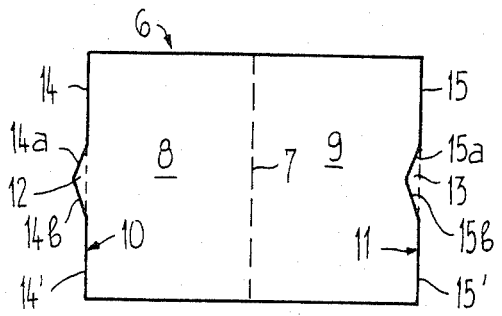
FIG. 4*a* is a view, comparable to the showing of FIG. 2*a,* of a third embodiment of printed sheet in its open or unfolded condition.
Figure 4B:
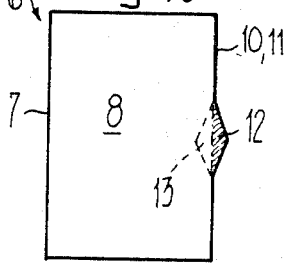
FIG. 4*b* illustrates the printed sheet of FIG. 4*a* in its folded condition.

With the embodiment of printed sheet 6 illustrated in FIGS. 4*a* and 4*b*, the likewise essentially triangular-shaped portions 12 and 13 are arranged essentially at the center of the corresponding side edges 10 and 11. The protruding portion 12 is here located at the side edge 10 and the inset or retracted portion 13 is located at the opposite side edge 11. The corresponding line bounding the related side edges 10 and 11 here consists of two regions 14, 14', and 15, 15', respectively, extending essentially parallel to the fold line 7 and two regions 14*a*, 14*b* and 15*a*, 15*b*, respectively, enclosing an angle with such regions. As also will be recognized by inspecting FIG. 4*b*, by virtue of the provision of the protruding portion 12 and the inset or retracted portion 13 there is afforded an engagement or attack possibility for the opening device. After completion of the manipulation operation the protruding portion 12 is likewise cut away along a cutting line defined by the side edge 10.

Figure 5A:
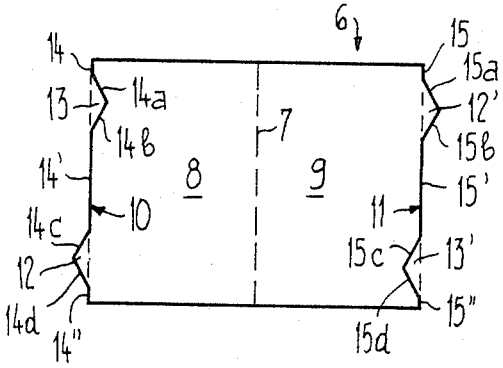
FIG. 5*a* illustrates in top plan view a fourth embodiment of printed sheet in its open condition.
Figure 5B:
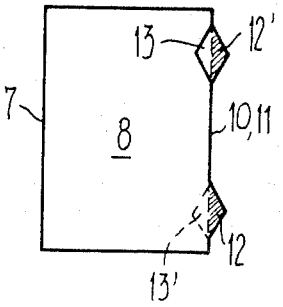
FIG. 5*b* illustrates the printed sheet of FIG. 5*a* in its folded condition.

Continuing, the exemplary embodiment of printed sheet depicted in FIGS. 5*a* and 5*b* differs from the previously described embodiments in that, here, the printed sheet 6 possesses at each side edge 10 and 11 a protruding portion 12 and 12', respectively, and an inset or retracted portion 13 and 13', respectively. Consequently, the boundary lines of the side edges 10 and 11 possess portions 14, 14', 14'' and 15, 15', 15'', respectively, which extend essentially parallel to the fold line, and portions 14*a*, 14*b*, 14*c*, 14*d* and 15*a*, 15*b*, 15*c*, 15*d*, respectively, which extend at an inclination to such regions. As will be particularly well recognized from FIG. 5*b*, it is now possible for performing the opening operation to engage both sides or sheet portions 8 and 9, since, as already explained, there is provided at the side edges 10 and 11 of each of these sides or sheet portions 8 and 9 a protruding portion or part 12', respectively. This renders possible a positive and exact opening of the folded printed sheet 6, something not as readily possible for the variant constructions of printed sheets shown in FIGS. 2*a*, 2*b*, 3*a*, 3*b* and 4*a*, 4*b*, since only one of both sides 8 and 9 can be directly engaged by the opening device.

The advantage which has been explained based upon the embodiment of printed sheet 6 as disclosed in FIGS. 5*a* and 5*b*, also can be obtained with the embodiments of sheet depicted in FIGS. 3*a* and 3*b*, if there is provided at each side edge 10 and 11 a protruding portion or part 12 or 12*a* and an inset or retracted portion or part 13 or 13*a*, respectively.

Just as was the case for the previously described exemplary embodiments, here also with the printed sheet 6 of the embodiment of FIGS. 5*a* and 5*b* the protruding portions or parts 12 and 12', after completion of the manipulation of the printed sheet 6, are cut away or cut-off along cutting lines defined by the related side edges 10,11.

With the exemplary embodiments of printed sheets depicted in FIGS. 2*a*, 2*b*, 3*a*, 3*b*, 4*a*, 4*b* and 5*a*, 5*b* the portions 14, 14', 14'' and 15, 15', 15'' of the side edges 10 and 11, respectively, which extend essentially parallel to the fold line 7, even after cutting away the protruding portions 12, 12*a*, 12', form part of the side edges 10 and 11 of the cut printed sheet 6 and which side edges extend essentially parallel to the fold line 7. With the exemplary embodiment depicted in FIGS. 6, 6*a* and 7*a*, 7*b* this no longer is the case since, in the uncut condition the broken line indicated side edges 10 and 11 are only virtually present. With these variant constructions of printed sheet 6 as depicted in FIGS. 6*a*, 6*b* and 7*a*, 7*b*, there directly merge with one another at each of the side edges 10 and 11 the protruding portions or parts 12, 12*a*, 12' and the inset or retracted portions or parts 13, 13', 13*a'*.

Figure 6A:
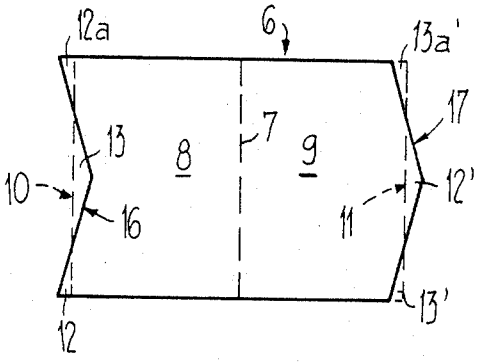
FIG. 6*a* illustrates in top plan view a fifth embodiment of printed sheet in its open position.
Figure 6B:
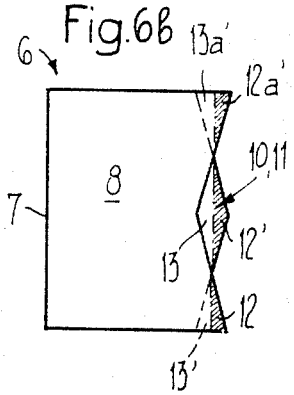
FIG. 6*b* illustrates the printed sheet of FIG. 6*a* in its folded condition.

With the exemplary embodiment of sheet 6 depicted in FIGS. 6*a* and 6*b* there are provided at the ends of the side edge 10 two protruding portions or parts 12 and 12*a* and intermediate thereof an inset or retracted portion 13, whereas at the opposite side edge 11 there are provided at its ends two inset or retracted portions or parts 13' and 13*a'*, between which there is arranged a protruding portion 12'. As particularly well seen by inspecting FIG. 6*a*, the printed sheet 6 is bounded at the side edges 10 and 11 by substantially V-shaped boundary lines 16 and 17, respectively.

As will be particularly evident from FIG. 6*b*, there protrude at the folded printed sheet 6, at the side 8, two protruding portions 12 and 12*a*, and at the side 9 an intermediately situated protruding portion or part 12'. Therefore, to open the folded printed sheet 6 both sides 8 and 9 can be directly acted upon or engaged by the opening device. At the end of the processing operation the protruding portions or parts 12, 12*a*, 12' are cut away along cutting lines defined by the side edges 10 and 11 and extending essentially parallel to the fold line 7, as the same has been indicated in FIG. 6*b*. When the printed sheet 6 has been cut there is missing at the side or sheet portion 8 a part corresponding to the inset or retracted portion or part 13, whereas there are missing at the other side or sheet portion 9 two portions or parts corresponding to the inset portions or parts 13' and 13*a'*.

Figure 7A:
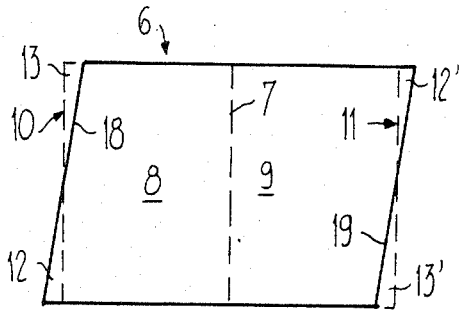
FIG. 7*a,* illustrates in top plan view a still further embodiment of printed sheet in its open condition.
Figure 7B:
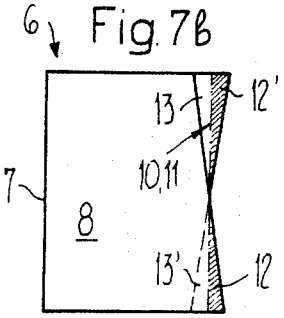
FIG. 7*b* illustrates the printed sheet of FIG. 7*a* in its folded condition.

With the variant construction of printed sheet 6 as depicted in FIGS. 7*a* and 7*b*, there is provided at each side edge 10 and 11 a protruding portion or part 12 and 12', respectively, and an inset or retracted portion or part 13 and 13', respectively, and which merge with one another, shown. At the side edges 10 and 11 the printed sheet 6 is bounded by two straight boundary lines 18 and 19, which in the open condition of the sheet extend parallel to one another and, as clearly shown in FIG. 7*a*, at an angle with respect to the fold line 7. For opening the folded printed sheet 6, as best seen by referring to FIG. 7*b*, the opening device likewise can engage at each side or sheet portion 8 and 9 at the protruding portions 12 and 12', respectively, provided at each such related side or sheet portion 8 and 9. Just as was the case for the variant embodiment of printed sheet 6 as depicted in FIG. 6*a* and 6*b* the portions 12 and 12' are separated or severed by a cut made along cutting lines defined by the side edges 10 and 11 and extending essentially parallel to the fold line 7. At each side or sheet portion 8 and 9 there remains a missing part which corresponds to the inset portion 13 and 13', respectively.

Opening of the inventive printed sheets 6 basically can be accomplished in the same manner as with the conventional printed sheets 1, for instance like in the manner described in German Patent Publication No. 3,047,436 and the corresponding copending, commonly assigned, U.S. application Ser. No. 06/214,460, filed Dec. 8, 1980 now U.S. Pat. No. 4,398,710, granted Aug. 16, 1983. Although the protruding portion or part 12 no longer extends over the entire length of the related side edge 10 or 11, as the case may be, as such is the case with the heretofore known printed sheets 1, there is nonetheless afforded, with the inventive constructions of printed sheets, a faultless opening of the folded printed sheets 6.

The inventive printed sheets 6, just as the conventional printed sheets, basically can be produced by cutting the printed paper web in folding equipment of conventional relief printing or photogravure or intaglio roll printing presses. For cutting the known printing sheets 1 there are used conventional cutting cylinders equipped with linearly extending cutters or blades which extend at right angles to the direction of movement of the paper web. On the other hand, to fabricate the inventive printed sheets, it is only necessary to provide, instead of a linear cutter or blade, a cutter which is bent or angled once or a number of times, this cutter travelling transversely with regard to the direction of movement of the paper web and having a configuration which corresponds to the boundary lines 14, 15 or 16 or 17 of the side edges 10 and 11, respectively. To cut the printed sheet 6 depicted in FIG. 7*a* and 7*b*, while there is indeed used a linear cutter, nonetheless such cutter or blade must be placed at an inclination with regard to the direction of movement of the paper web. This mode of fabrication is possible because, in the opened condition of the printed sheet 6, the boundary lines 14, 15; 16, 17; 18, 19 of the side edges 10 and 11 extending in the direction of the fold line 7 extend parallel to one another.

With all of the exemplary embodiments of the inventive printing sheets 6 the waste material of each protruding portion or part, which is formed during the cutting operation, is saved by a portion of corresponding area or size which is constituted by the inset or retracted portion or part 13. Consequently, there do not arise any losses in paper material for the business establishment or plant which processes the printed sheets. The unavoidable paper waste is produced in a certain sense at the expense of the reader of the final product. The inventive printed sheets 6 are particularly manifested by the features that, there is provided at least at one side or sheet portion, at its edge, at least a missing portion or part, a notch. These notches can be beneficially used as indexing or gripping register if there is produced a final or end product composed of a number of printed sheets which are tucked or stuffed within one another. Such gripping or indexing registers or tab indexes facilitates for the reader easy opening of the final product to a predetermined location. It should be understood that the protruding and inset portions 12 and 13, respectively, can also have a different configuration than the substantially triangular shape which has been shown; for instance, they can have the shape of a semi-circle or a segment of a circle. The number of protruding and inset portions 12 and 13 at each side edge 10 and 11 as well as also their distribution over the length of the related side edge can be randomly selected. The inventive constructions of printed sheets 6 are particularly suitable, but not however exclusively, for use with newspapers and periodicals, preferably those present in a so-called tabloid format.

While there are shown and described present preferred embodiments of the invention, it is to be distinctly understood that the invention is not limited thereto, but may be otherwise variously embodied and practiced within the scope of the following claims. ACCORDINGLY,

What I claim is:

1. A folded printed sheet or a printed sheet intended to be folded and operated upon by automatic stacking or tucking equipment, comprising:

a sheet of essentially uniform thickness having opposed side edges and a fold line intermediate said opposed side edges;

said opposed side edges forming a first side edge and a second side edge;

at least one protruding portion provided at the first side edge;

said at least one protruding portion adapted to be cut-away after completion of a sheet handling operation;

said at least one protruding portion extending only over a portion of the length of the first side edge;

an inset portion provided at the second side edge located opposite the first side edge with respect to said fold line;

said inset portion having a shape essentially corresponding to that of said at least one protruding portion;

wherein the first side edge and the second side edge, in an unfolded condition of the sheet, extend essentially parallel to one another along a related bent line which is bent at least once; and the first side edge and the second side edge possess a region extending essentially parallel to the fold line and at least one region forming an angle with respect to the region extending parallel to the fold line.

2. The printed sheet as defined in claim 1, further including:

at least one protruding portion and at least one inset portion provided at each said first side edge and at each said second side edge; and said at least one inset portion provided at each said first side edge and said second side edge essentially corresponding to the at least one protruding portion provided at the other respective side edge.

3. The printed sheet as defined in claim 2, wherein:

said protruding portion and said inset portion adjoin each other at each side edge.

4. The printed sheet as defined in claims 1 or 2, wherein:

the first side edge and the second side edge, in an unfolded condition of the sheet, extend essentially parallel to one another along a related bent line which is bent at least once.

5. The printed sheet as defined in claim 4, wherein:

the first side edge and the second side edge possess a region extending essentially parallel to the fold line and at least one region forming an angle with respect to the region extending parallel to the fold line.

6. The printed sheet as defined in claim 1, wherein:

each said protruding portion and said inset portion have a substantially triangular-shaped configuration.

7. A folded printed sheet or a printed sheet intended to be folded, comprising:

a sheet of essentially uniform thickness having opposed side edges and a fold line intermediate said opposed side edges;

said opposed side edges forming a first side edge and a second side edge;

at least one protruding portion provided at the first side edge;

said at least one protruding portion adapted to be cut-away after completion of a sheet handling operation;

said at least one protruding portion extending only over a portion of the length of the first side edge;

an inset portion provided at the second side edge located opposite the first side edge with respect to said fold line;

said inset portion having a shape essentially corresponding to that of said at least one protruding portion;

at least one protruding portion and at least one inset portion provided at each said first side edge and at each said second side edge;

said at least one inset portion provided at each said first side edge and said second side edge essentially corresponding to the at least one protruding portion provided at the other respective side edge;

wherein said protruding portion and said inset portion adjoin each other at each side;

each said first side edge and said second side edge defines a related boundary line; and said boundary lines at the first side edge and the second side edge, in an unfolded condition of the sheet, extend linearly and parallel to one another as well as at an inclination with respect to the fold line.

8. A folded printed sheet or a printed sheet intended to be folded, comprising:

a sheet of essentially uniform thickness having opposed side edges and a fold line intermediate said opposed side edges;

said opposed side edges forming a first side edge and a second side edge;

at least one protruding portion provided at the first side edge;

said at least one protruding portion adapted to be cut-away after completion of a sheet handling operation;

said at least one protruding portion extending only over a portion of the length of the first side edge;

an inset portion provided at the second side edge located opposite the first side edge with respect to said fold line;

said inset portion having a shape essentially corresponding to that of said at least one protruding portion;

at least one protruding portion and at least one inset portion provided at each said first side edge and at each said second side edge;

said at least one inset portion provided at each said first side edge and said second side edge essentially corresponding to the at least one protruding portion provided at the other respective side edge;

wherein said protruding portion and said inset portion adjoin each other at each side;

each said first side edge and said second side edge defines a related boundary line; and said boundary lines which extend essentially parallel to one another, in an unfolded condition of the sheet, extend in a substantially V-shaped configuration at the first side edge and at the second side edge.

* * * * *